US006585603B2

(12) United States Patent
Montalvo

(10) Patent No.: US 6,585,603 B2
(45) Date of Patent: Jul. 1, 2003

(54) GOLF BALL TEEING DEVICE HAVING A SINGLE-PIECE ARM AND A JOGGER

(76) Inventor: Samuel A. Montalvo, 18750 Barnhart Ave., Cupertino, CA (US) 95014

( * ) Notice: Subject to any disclaimer, the term of this patent is extended or adjusted under 35 U.S.C. 154(b) by 0 days.

(21) Appl. No.: 09/835,057

(22) Filed: Apr. 13, 2001

(65) Prior Publication Data

US 2002/0151372 A1 Oct. 17, 2002

(51) Int. Cl.[7] ..... A63B 69/36
(52) U.S. Cl. ..... 473/136; 473/137
(58) Field of Search ..... 473/132–137

(56) References Cited

U.S. PATENT DOCUMENTS 2,675,237 A * 4/1954 Willcox ..... 473/136
3,003,770 A * 10/1961 Jones ..... 473/134
3,756,606 A * 9/1973 Land ..... 473/136
4,796,893 A * 1/1989 Choi ..... 473/137
5,052,688 A * 10/1991 Shiau ..... 473/135
5,346,222 A 9/1994 Luther, Sr.
5,458,339 A 10/1995 Wildes
5,624,325 A 4/1997 Smith ..... 473/137
5,674,130 A 10/1997 Egan ..... 473/132
5,895,325 A 4/1999 Tomey ..... 473/134
5,971,862 A * 10/1999 Yates ..... 473/137

* cited by examiner

*Primary Examiner*—Steven Wong
(74) *Attorney, Agent, or Firm*—Law Offices of Terry McHugh

(57) ABSTRACT

A golf teeing device includes a one-piece singulation arm having a ball-receiving region that is connected to a ball-seating region by a ramp region. The unitary singulation arm has a raised rest position and a lowered delivery position. The configuration of the ramp region channels a golf ball to the ball-seating region when the singulation arm is in its delivery position. The configuration of the ball-seating region inhibits horizontal movement of the ball in any direction when the ball reaches this region. In one embodiment, all three regions of the singulation arm have dimensions that are consistent with the channel of the ramp region. A ball-striking mechanism within a supply path to the singulation arm is activated to provide dislodging forces to at least two balls, thereby ensuring a consistent flow of balls to the singulation arm.

15 Claims, 4 Drawing Sheets

GOLF BALL TEEING DEVICE HAVING A SINGLE-PIECE ARM AND A JOGGER

TECHNICAL FIELD

The invention relates generally to golf ball dispensing devices and more particularly to devices and methods for repeatedly and reliably placing golf balls on a tee.

BACKGROUND ART

There are a wide variety of golf practice devices for the various aspects of the game. For example, there are ball-return mechanisms for practicing putting and there are specially designed golf clubs that react in such a way as to provide negative or positive feedback to a golfer when the club is used to strike a golf ball.

Most of the practice devices attempt to simulate game time experiences. In addition to attempting to simulate normal play, a goal of most practice devices is to promote muscle memory that is carried over to course play. Particularly with regard to driving a golf ball, following the same pattern in the execution of a swing is desirable.

Not all golf practice occurs using a device. For example, driving ranges are used to practice various strokes. Typically, a ball is taken from a container and placed on a tee or on a mat and hit into an open area. This conventional manual process works well, but the recurring requirement of removing golf balls from a container and placing them in position does nothing to improve the golf skills of the golfer. In fact, when practicing drives from a tee, the requirement of placing a ball on the tee after every shot acts against the goal of gaining muscle memory. Moreover, the process is tedious and has the potential of leading to muscle strain.

Devices for placing a golf ball on a tee are known. One such device is described in U.S. Pat. No. 5,346,222 to Luther, Sr. This device includes a tubular magazine through which golf balls roll by gravity from an entrance to an exit. A pivotable tubular arm is hinged at the exit of the magazine and is biased to hold its mouth at an elevation higher than the exit of the magazine. When the tubular arm is pivoted downwardly to a dispensing position, a single ball rolls through the arm to a nose guide which functions to position a golf ball on a tee. Another manual device is described in U.S. Pat. No. 5,458,339 to Wildes. The Wildes device includes a base having supports to provide a framework, a holder for a number of golf balls, a rocker arm for individually releasing the balls onto a ramp, and a manually operated lever that controls the rocker arm and ramp. By controlling the lever, a golf ball is placed on a tee. The device also includes an L-shaped member that is used as a dislodger. The dislodger is spring biased and is positioned to move any golf balls that are lodged in an upper portion of the device.

As an alternative to the manual devices, U.S. Pat. No. 5,895,325 to Tomey describes a device having an automated drive mechanism for teeing golf balls. The drive mechanism moves a track member rectilinearly from a fully retracted position to an extended teeing position at which the golf ball is delivered to a tee. The drive mechanism then returns the track member to its retracted position. A golf ball sensor detects whether a ball is positioned on the tee, so that the process can be repeated after the ball is hit. The device also includes an anti-jam mechanism for maintaining the flow of golf balls.

While the various devices are available, what is needed is a more cost-efficient device and method for repeatedly and reliably delivering balls to a hitting zone of a player.

SUMMARY OF THE INVENTION

A golf ball teeing device and method utilize a one-piece singulation arm having a ball-receiving region connected to a ball-seating region by a ramp region. The unitary singulation arm has a raised rest position and a lowered delivery position. The ball-seating region of the singulation arm is configured to inhibit horizontal movement of a ball in any direction when the singulation arm is in its delivery position. In the preferred embodiment, the teeing device also includes an electrically actuated ball-striking mechanism that is positioned to jog balls that are gravity fed to the singulation arm.

The singulation arm may be formed of tube stock from which material is removed to define the three regions, i.e., the ball-receiving region, the ramp region and the ball-seating region. As an alternative, the singulation arm may be formed using a molding process. The drive assembly for pivoting the singulation arm includes a motor, such as a rotary solenoid. By attaching the singulation arm to a rotary solenoid that turns electromagnetic pull motion into radial motion, the arm may be designed to rotate 95° from the vertical rest position to the delivery position that is at a 5° angle to the horizontal. This 5° tilt allows the ball to roll along the ramp region to the ball-seating region. The shape of the ball-seating region stops the progress of the ball and inhibits the ball from bouncing out of the region. In the preferred embodiment, the ball-seating region cooperates with a tee to reliably present a ball in a teed position for a golfer. Thus, the ball-seating region is open to provide access to the tee, but provides 360° of side protection while the singulation arm is in its delivery position.

The ball-striking mechanism for jogging the awaiting golf balls may also be solenoid actuated. Because of the materials used in forming the balls and because of the dimples that reside along the exterior of the balls, golf balls tend to jam at an entry point of a hopper into a single-file supply path. The ball-striking mechanism preferably includes a plunger that is projected to provide dislodging force to at least two balls simultaneously. The mechanism may be provided with a one-second pulse, immediately following the singulation process in which a ball is delivered to the tee.

The device is preferably contained within a portable housing that includes a battery to provide power for the electrical components. However, a line current embodiment has also been contemplated, with a power supply being used in place of the battery. An optical sensor determines when a ball has been delivered by the device. An advantage of the invention is that the single-piece singulation arm is economically fabricated, so that the overall cost of the device is manageable. Another advantage is that the ball-striking mechanism ensures a consistent flow of balls to the singulation arm. When a ball reaches the seating region of the singulation arm, the configuration of the seating region reliably directs a ball to a precise position.

DETAILED DESCRIPTION

Figure 1:
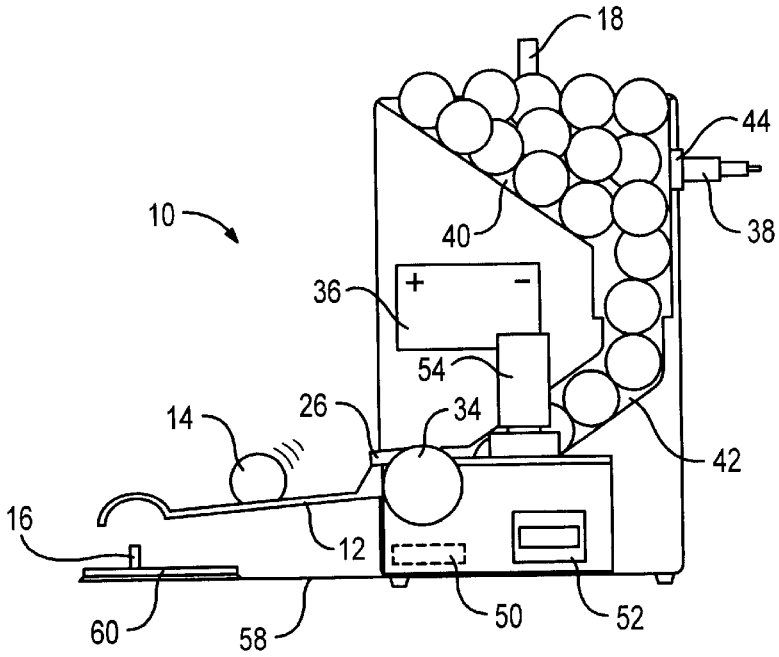
FIG. 1 is a side view of the interior of a golf teeing device having a one-piece singulation arm and a jogging mechanism in accordance with the invention.

With reference to FIG. 1, a golf teeing device 10 is shown as including a one-piece singulation arm 12 for delivering a golf ball 14 to a tee 16. In the preferred embodiment, the teeing device is a portable member that includes a handle 18. In the delivery position shown in FIG. 1, the singulation arm has a downward tilt toward the tee 16, so that the ball travels forwardly from the device to the tee. When the ball reaches the end of the arm, the shape of the ball-seating region of the arm ensures that the delivered ball is properly positioned.

Figure 2:
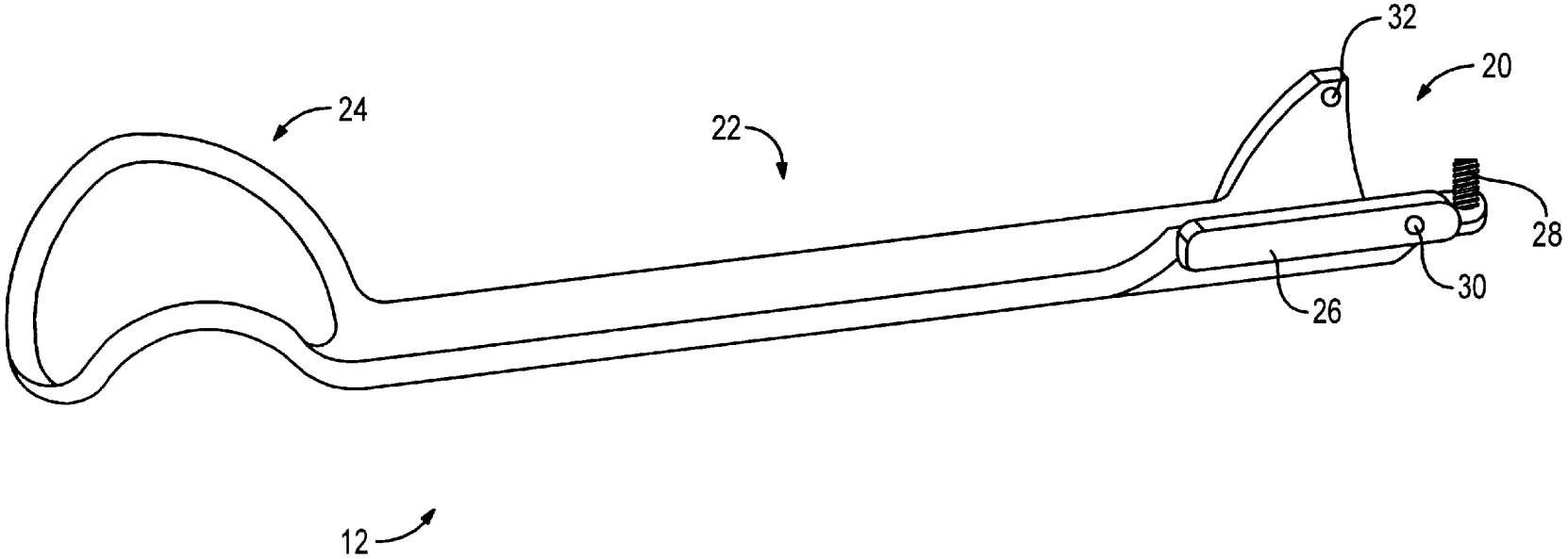
FIG. 2 is a perspective view of the singulation arm of FIG. 1.

Referring now to FIGS. 1 and 2, the singulation arm has a ball-receiving region 20, a ramp region 22 and a ball-seating region 24. While the different regions serve different purposes, in one embodiment, the dimensions of the arm are partially defined by a radius of curvature that is consistent throughout the arm. In this embodiment, the arm may be formed by machining material from off-the-shelf tube stock. Given the dimensions of a golf ball, a standard 50.8 millimeter (2 inch) tube may be utilized for this purpose. The ramp region 22 then has a curved cross section, so that a ball follows a channel along the region from the ball-receiving region 20 to the ball-seating region 24.

As an alternative to machining a tubular member, the singulation arm 12 may be formed using a molding process. Thus, a mold can be made from which parts are cast. Because the singulation arm is a single piece, the overall cost of the device 10 is significantly reduced, compared to devices that require a number of cooperative elements to deliver and seat a golf ball.

In addition to the singulation arm 12, FIG. 2 shows a mounting bracket 26 and a ball stop 28. The function of the ball stop will be described below. The mounting bracket 26 includes a pivot hole 30 that is aligned with a pivot hole 32 in the ball-receiving region 20 of the arm 12. In FIG. 1, the arm 12 is mounted to the other components of the device 10 via the pivot holes. A rotary solenoid 34 is also coupled at the pivot hole 30 of the mounting bracket 26. As is known in the art, a rotary solenoid can be used to translate electromagnetic pull motion into radial motion, allowing the device to pivot the singulation arm 12 to the delivery position of FIG. 1 from a generally vertical rest position in which the delivery arm resides within the housing of the device. A battery 36 or a power supply that is connected to an external line source provides power for operating the rotary solenoid.

The device 10 includes a second solenoid 38 that is also powered by the battery 36. This solenoid acts as a ball-striking mechanism for dislodging balls within a hopper 40 that gravity feeds golf balls to a supply path 42. The material that is used to form the exterior of a golf ball causes the balls to be particularly susceptible to jamming within a collection area such as the hopper 40. The dimples on the exterior of the golf balls contribute to this susceptibility to jamming.

Figure 3:
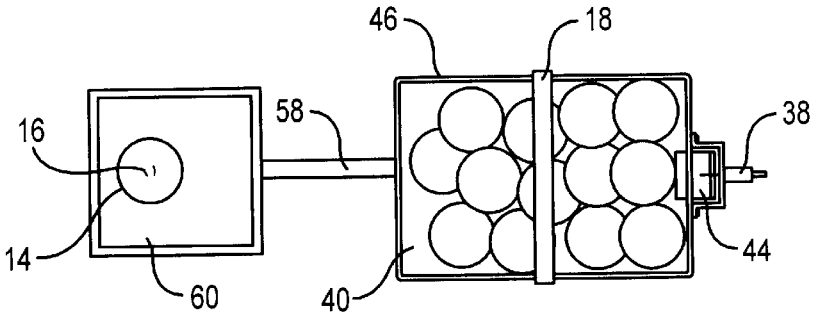
FIG. 3 is a top view of the golf teeing device of FIG. 1 shown in a rest condition in which the singulation arm extends into the housing of the device.
Figure 4:
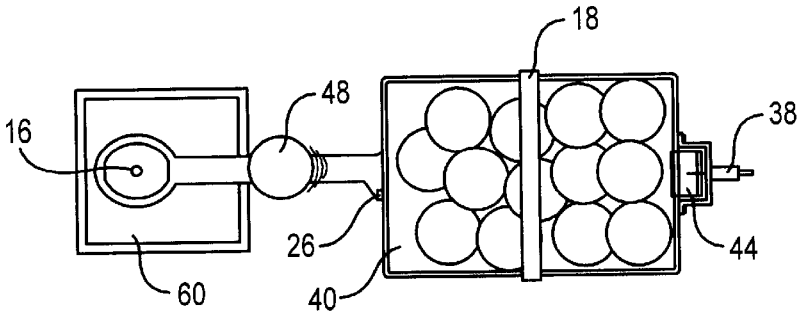
FIG. 4 is a top view of the golf teeing device of FIG. 3 shown in a ball delivery condition.

Referring now to FIGS. 1 and 3, after the golf ball 14 has been seated on the tee 16, the singulation arm 12 is raised into a vertical position in which it resides within a housing 46 of the device 10. Since the jamming of golf balls at the entry point of the supply path 42 is a concern, the jogger solenoid 38 is provided with a pulse (e.g., a one-second pulse) immediately following the singulation process. The jogger solenoid 38 should be situated in such a way as to provide simultaneous dislodging force to at least two golf balls, which may be vertically adjacent to each other or horizontally adjacent to each other. The pulse is delivered with the singulation arm 12 in the vertical rest position. In FIG. 4, the jogger solenoid 38 is shown as being retracted and the lowering of the singulation arm 12 causes a second golf ball 48 to be delivered to the tee 16.

The timing of the pivoting of the singulation arm 12 between its lowered delivery position and its raised rest position may be fixed by a timer. However, in the embodiment of FIGS. 1–4, the cycling is optically controlled. An optical sensor 50 has a field of view that is directed toward the tee 16. When the sensor does not detect a ball on the tee, the singulation arm 12 is pivoted to the delivery position of FIG. 1. On the other hand, when a ball is seated on the tee, the sensor generates a signal which causes the singulation arm to pivot upwardly to its rest position. The sensor may be a standard device that generates a signal that is responsive to the presence or absence of a ball on the tee. The signal toggles a sensor relay 52 that is connected to the rotary solenoid 34. Alternatively, the pivoting of the singulation arm may be a combination of optical sensing and preset timing. For example, the sensor 50 may determine when the arm is to be pivoted from the delivery position to the rest position, while an adjustable timer is used to regulate the timing of the next delivery.

Figure 5:
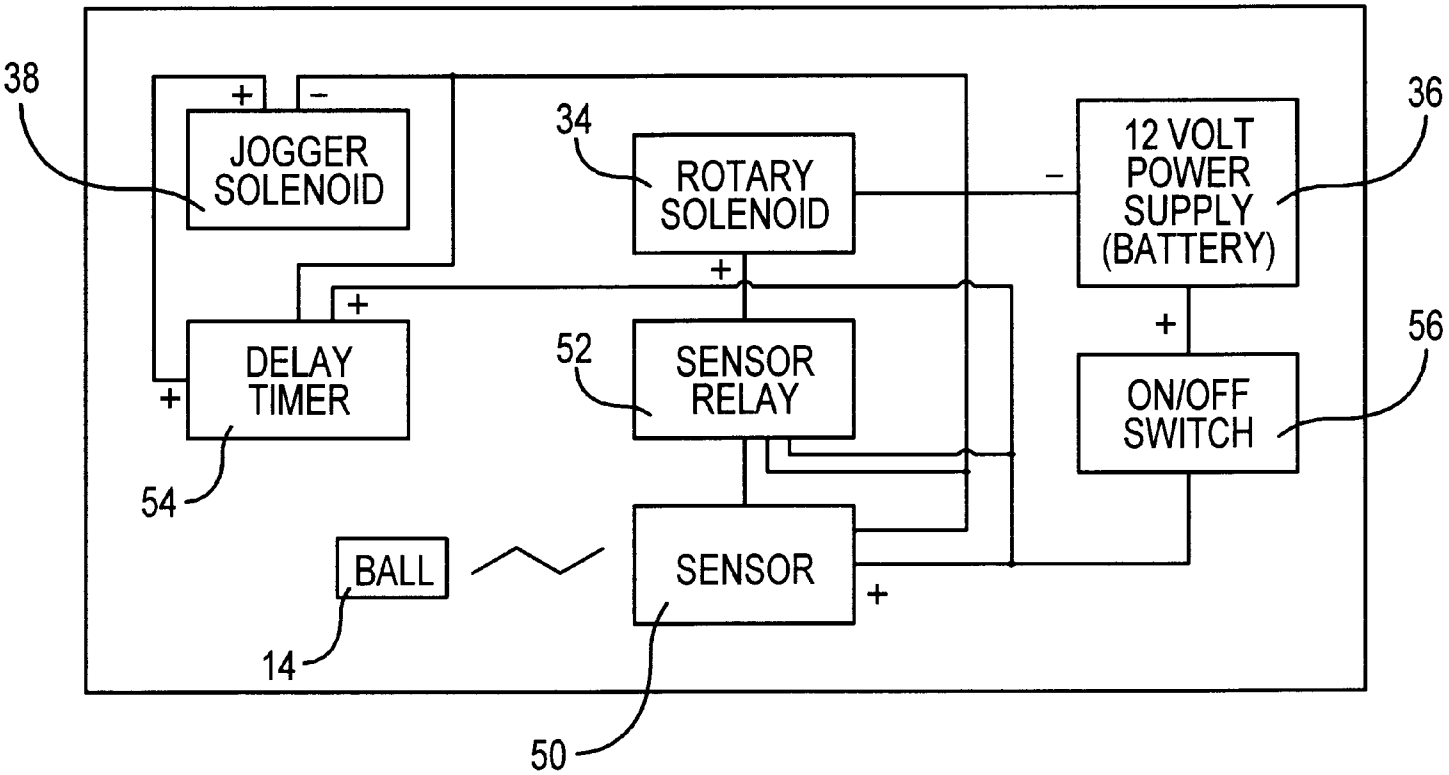
FIG. 5 is a schematic view of the electrical components of the golf teeing device of FIG. 1.

The device 10 also includes a delay timer 54 which is connected to the jogger solenoid 38. The delay timer determines the operation of the jogger solenoid. With reference to FIG. 5, the various electrical components are shown. The battery 36 or a 12-volt power supply can be disconnected by operation of an on/off switch 56. When the sensor 50 detects the presence of a golf ball 14 on a tee, the sensor generates a signal that is directed to the sensor relay, which terminates power to the rotary solenoid 34. This returns the singulation arm to its vertical rest position. Power to the jogger solenoid 38 is controlled by the delay timer 54. While not shown, the delay timer may be connected to the sensor relay to ensure that the jogger solenoid is activated only when the singulation arm is in its raised rest position.

Referring again to FIGS. 1 and 3, the distance between the golf teeing device 10 and the tee 16 may be fixed by use of a centering arm 58. Many driving ranges provide practice mats 60 having artificial turf on an upper surface and having a hole through which reusable rubber tees extend. Practice mats and rubber tees may also be purchased at golf equipment stores. The centering arm 58 has a precise length and an upwardly extending pin (not shown) that mates with a center hole within the conventional rubber tee. Thus, the device 10 can be properly aligned and can maintain its alignment merely by placing the pin of the centering arm through the tee.

Figure 8:
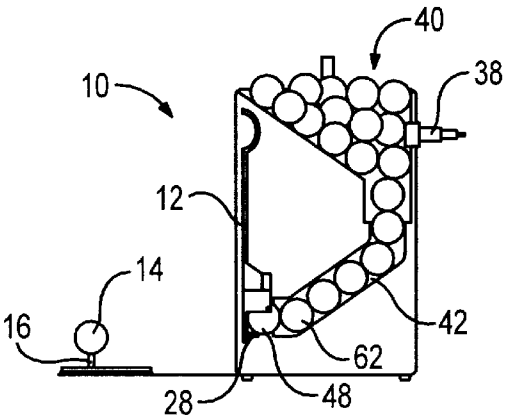
FIGS. 6, 7 and 8 are side views of the golf teeing device of FIG. 1, showing a sequence of steps in which a golf ball is delivered to a tee.
Figure 7:
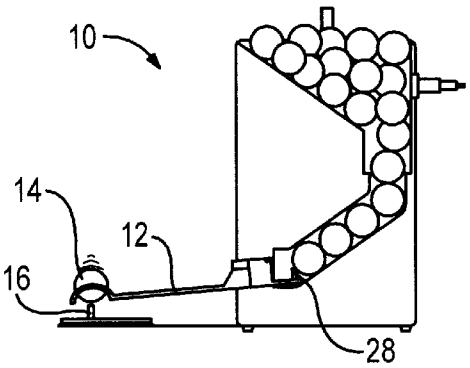
Figure 6:
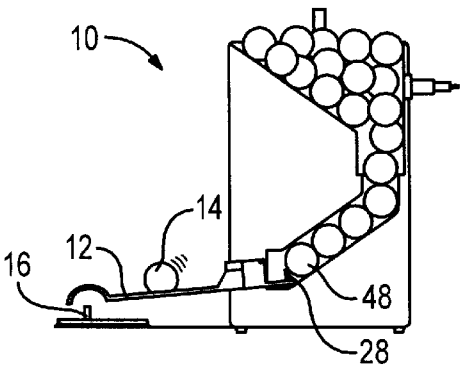

The sequence of steps is illustrated in FIGS. 6, 7 and 8. In FIG. 6, the singulation arm 12 is in its delivery position as a result of activation of the rotary solenoid 34, so that a golf ball 14 rolls along the channel of the ramp region of the arm toward the tee 16. As noted with regard to FIG. 2, a ball stop 28 extends through the singulation arm. The ball stop allows the forwardmost ball 14 to progress along the singulation arm, but prevents the next ball 48 from following. The ball stop may merely be an externally threaded fastener that passes through the singulation arm sufficiently far to block the next ball. In FIG. 7, the golf ball 14 has completed its travel along the ramp region of the singulation arm 12, so that the ball drops into position on the tee 16. The configuration of the singulation arm at its ball-seating region ensures that the ball is prevented from further movement in the forward direction, the rearward direction or either lateral directions. Consequently, the ball is reliably positioned onto the tee 16.

In the next step, the sensor detects that a ball is present at the tee 16. The rotary solenoid is deactivated and the singulation arm 12 is allowed to return to its rest position shown in FIG. 8. In this position, the lower portion of the arm blocks possible movement of the golf balls along the supply path 42. The jogger solenoid is pulsed to strike at least two golf balls within the hopper 40 at an area adjacent to the supply path. The dislodging forces on at least two golf balls clear any potential jams. The device 10 is then available to deliver a next ball 48 when the teed ball 14 is driven from the tee 16. As shown in FIG. 8, the ball stop 28 extends below the next ball 48. As the singulation arm 12 is again lowered to the position shown in FIG. 6, the ball stop 28 singles out the next ball 48. Preferably, the ball stop also pushes the following ball 62 rearwardly, so that any jams along the supply path are cleared. The cycling can continue until all of the golf balls within the hopper 40 have been delivered.

While the device has been described as a golf teeing device, it is not critical that the "teeing" action is one in which the balls are centered on a golf tee. The golf balls may be positioned on an alternative surface. Thus, the teeing may be a positioning of the golf balls on the mat 60 of FIG. 1.

What is claimed is:

1. A golf ball teeing device comprising:

a ball supply path configured to direct a stream of golf balls to a ball outlet position;

a hopper positioned to gravity feed golf balls to said supply path;

a jogger positioned with respect to said hopper and said supply path to selectively strike said golf balls contained within said hopper so as to reposition at least a Portion of said golf balls contained within said hopper, said jogger being a solenoid driven member that is located to strike said golf balls in an area proximate to a junction of said hopper and said supply path;

a one-piece singulation arm having a ball-receiving region linked to said supply path and having a ball-seating region and a ramp region that extends from said ball-receiving region to said ball-seating region, said singulation arm having a delivery position and a rest position, said ball-seating region being configured to inhibit horizontal movement of a ball in any direction when said singulation arm is in said delivery position, said singulation arm having a unitary construction;

a drive assembly configured to automatically manipulate said singulation arm to move between said delivery position and said reset position.

2. The teeing device of claim 1 further comprising control circuitry for activating said solenoid driven member and for manipulating said singulation arm between said delivery and rest positions, wherein said control circuitry is configured to activate said solenoid driven member for each activation of said drive assembly to deliver a golf ball.

3. The teeing device of claim 1 wherein said singulation arm is a unitary member with a constant curvature in a cross section through said ramp region, said curvature being selected to maintain a golf ball traveling from said ball-receiving region to said ball-seating region, said ramp region having an open top area, as viewed when said singulation arm is in said delivery position.

4. The teeing device of claim 3 wherein said ball-seating region of Said singulation arm is configured to cooperate with a tee member to seat said golf balls on said tee member, said ball-seating region defining an open bottom for passage of said golf balls and having sides that are consistent with said curvature of said ramp region.

5. The teeing device of claim 4 wherein said drive assembly includes a motor coupled to said singulation arm to pivot said singulation arm from a generally vertical said rest position to said delivery position in which said singulation arm is angled downwardly from said ball-receiving region to said ball-seating region.

6. The teeing device of claim 5 further comprising a stop at said ball-receiving region of said singulation arm, said stop being positioned and configured to extend between a forwardmost ball and a next ball along said supply path when said singulation arm is pivoted to said delivery position, thereby blocking said next ball from following said forwardmost ball.

7. The teeing device of claim 6 wherein said stop is positioned to displace said next ball when said singulation arm is pivoted to said delivery position.

8. The teeing device of claim 4 further comprising a sensor assembly configured to sense when said tee member is available to receive a golf ball.

9. A method of automatically teeing a succession of golf balls comprising:

forming a singulation arm from a single piece of material such that said singulation arm has a ball-receiving end connected to a ball-seating end by a ramp region;

coupling said singulation arm to a supply path for golf balls such that said supply path is blocked when said singulation arm is in a raised position and is in a ball-transfer relationship with said singulation arm when said singulation arm is in a lowered position;

selectively pivoting said singulation arm between said raised position and said lowered position, thereby delivering a golf ball; and triggering a ball-striking mechanism along said supply path in response to detection that a golf ball has been delivered by pivoting of said singulation arm, said ball-striking mechanism being electrically actuated.

10. The method of claim 9 further comprising a step of positioning a tee member relative to said singulation arm such that a golf ball is seated on said tee member each time that said singulation arm is pivoted to said lowered position.

11. The method of claim 10 further comprising a step of optically sensing when said tee member is without a golf ball, said selective pivoting of said singulation arm being a response to said optical sensing.

12. The method of claim 9 wherein said step of triggering said ball-striking mechanism includes locating a plunger adjacent to a region in which a ball hopper meets a gravity feed ramp in which golf balls from said hopper are restricted to single-file movement.

13. The method of claim 12 wherein said step of triggering said ball-striking mechanism includes selectively activating a solenoid that displaces said plunger in a direction to dislodge at least two golf balls when said hopper contains a collection of golf balls.

14. The method of claim 12 further comprising a step of rearwardly displacing a next golf ball that is at a lower end of said supply path when said singulation arm is pivoted from said raised position to said lowered position, said lower end being an end of said supply path adjacent to said singulation said next golf ball being one that follows said golf ball which is being delivered.

15. The method of claim 14 wherein said step of rearwardly displacing is executed by a stop that is connected to said singulation arm, said stop being positioned to prevent a plurality of golf balls from entering said singulation arm when pivoted to said lowered position.

* * * * *